US010166459B1

(12) United States Patent
Chen

(10) Patent No.: US 10,166,459 B1
(45) Date of Patent: Jan. 1, 2019

(54) MODULAR RAMP SYSTEM

(71) Applicant: Wang-Chuan Chen, Taichung (TW)

(72) Inventor: Wang-Chuan Chen, Taichung (TW)

( * ) Notice: Subject to any disclaimer, the term of this patent is extended or adjusted under 35 U.S.C. 154(b) by 0 days.

(21) Appl. No.: 15/886,941

(22) Filed: Feb. 2, 2018

(30) Foreign Application Priority Data

Dec. 15, 2017 (CN) ..... 2017 2 1763469 U

(51) Int. Cl.
*A63C 19/02* (2006.01)

(52) U.S. Cl.
CPC ..... *A63C 19/02* (2013.01); *A63C 2201/02* (2013.01); *A63C 2203/10* (2013.01)

(58) Field of Classification Search
CPC .. A63C 19/02; A63C 2201/02; A63C 2230/10
See application file for complete search history.

(56) References Cited

U.S. PATENT DOCUMENTS 6,042,480 A * 3/2000 Labelson ..... A63C 19/10 14/69.5
6,654,977 B1 * 12/2003 Chin ..... A63C 19/10 14/69.5
6,676,529 B2 * 1/2004 Pernal ..... A63C 19/10 472/89
6,695,707 B1 * 2/2004 Fernandez ..... A63C 19/10 14/69.5
6,993,801 B2 * 2/2006 Marko ..... A63C 19/10 14/69.5
8,196,244 B2 * 6/2012 Mapp ..... E01C 13/003 14/69.5
8,852,008 B2 10/2014 Chen
9,675,869 B1 * 6/2017 Chin ..... A63C 19/10
2003/0125120 A1 * 7/2003 Montolio ..... A63C 19/10 472/89

* cited by examiner

*Primary Examiner* — Michael Dennis
(74) *Attorney, Agent, or Firm* — Alan D. Kamrath; Kamrath IP Lawfirm, P.A.

(57) ABSTRACT

A modular ramp system includes a ramp component and a connector releasably joined to the ramp component. The ramp component has first and second inclined surfaces and a connecting portion positioned between the first and second inclined surfaces. The connector has a bottom side formed with first and second coupling sections connectible to the connecting portion. The connector is positionable in a first position in which one of the first and second coupling sections is releasably joined to the connecting portion of the ramp component, and the other of the first and second coupling sections is adapted to releasably couple to a ramp or an external structure, and is positionable in a second position in which the first and second coupling sections are releasably joined to the connecting portion of the ramp component.

16 Claims, 7 Drawing Sheets

MODULAR RAMP SYSTEM

BACKGROUND OF THE INVENTION

1. Field of the Invention

The present invention relates to a ramp system and, particularly, to a ramp set a ramp that is a modular ramp system and that is created for extreme sports.

2. Description of the Related Art

U.S. Pat. No. 8,852,008 is a ramp system for extreme sports. The ramp system is built from two ramp components. The ramp components are connected back to back with one another, so that in a direction of travel, a user to travel up one ramp component and then immediately down the other. The ramp system only has one configuration. In addition, it is still desirable to provide a ramp system which can withstand the extreme forces generated by the use of skateboards, in-line skates, scooters and bicycles while providing a smooth segment transition.

The present invention is, therefore, intended to obviate or at least alleviate the problems encountered in the prior art.

SUMMARY OF THE INVENTION

According to the present invention, a modular ramp system includes a ramp component and a connector releasably joined to the ramp component. The ramp component is made from a single piece material. The ramp component has a bottom surface, a top surface above the bottom surface at a height, a first and second inclined surface extending from opposite sides of the top surface to the bottom surface, and a connecting portion formed on the top surface and positioned between the first and second inclined surfaces. The connector has a bottom side formed with a first and second coupling section connectible to the connecting portion. The connector is positionable in a first position in which one of the first and second coupling sections is releasably joined to the connecting portion of the ramp component and the other of the first and second coupling sections is adapted to releasably couple to a ramp or an external structure, and a second position in which the first and second coupling sections are releasably joined to connecting portion of the ramp component.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention. Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide a modular ramp system for extreme sports.

It is another objective of the present invention that the modular ramp system has components adapted to be assembled together in a variety of configurations and is capable of ready assembly and disassembly.

It is yet another objective of the present invention that the modular ramp system is sturdy.

Other objectives, advantages, and new features of the present invention will become apparent from the following detailed description of the invention when considered in conjunction with the accompanied drawings.

DETAILED DESCRIPTION OF THE INVENTION

Figure 1:
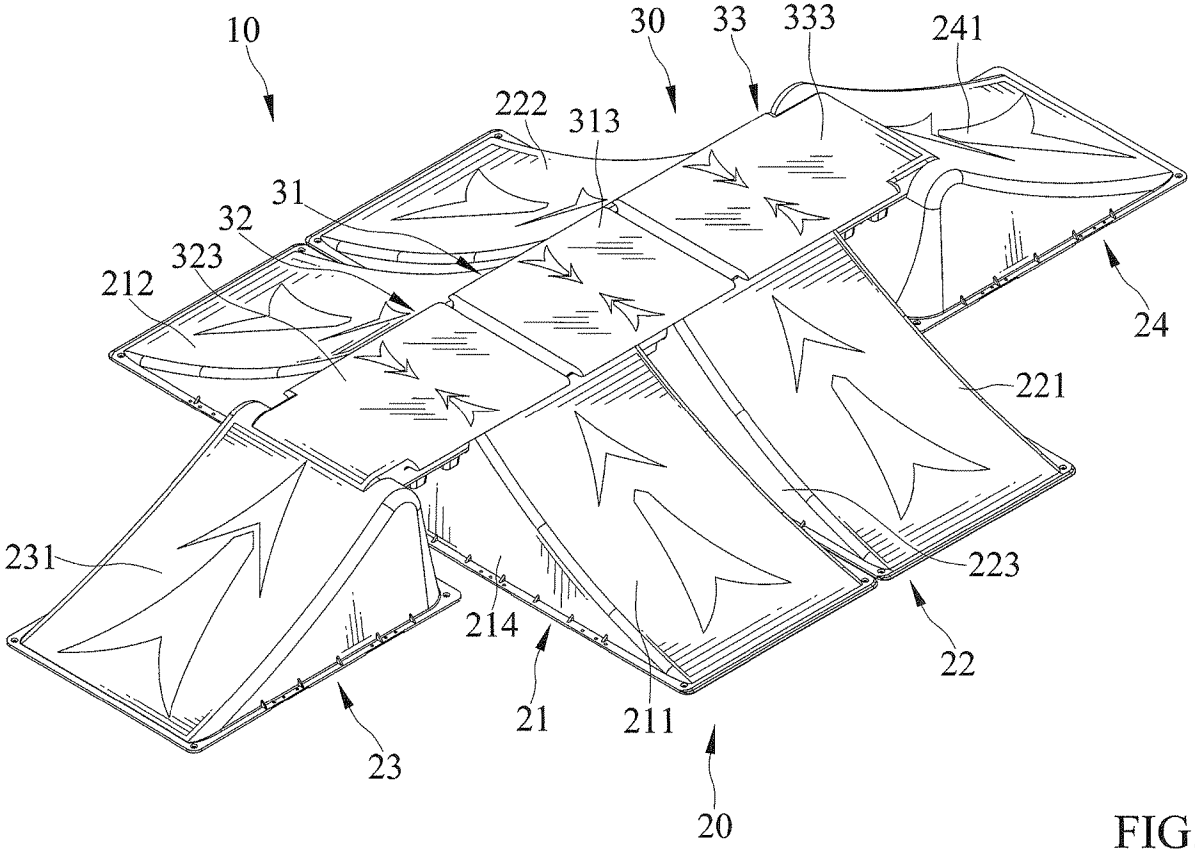
FIG. 1 is perspective view of a modular ramp system in accordance with the present invention in a first configuration.
Figure 2:
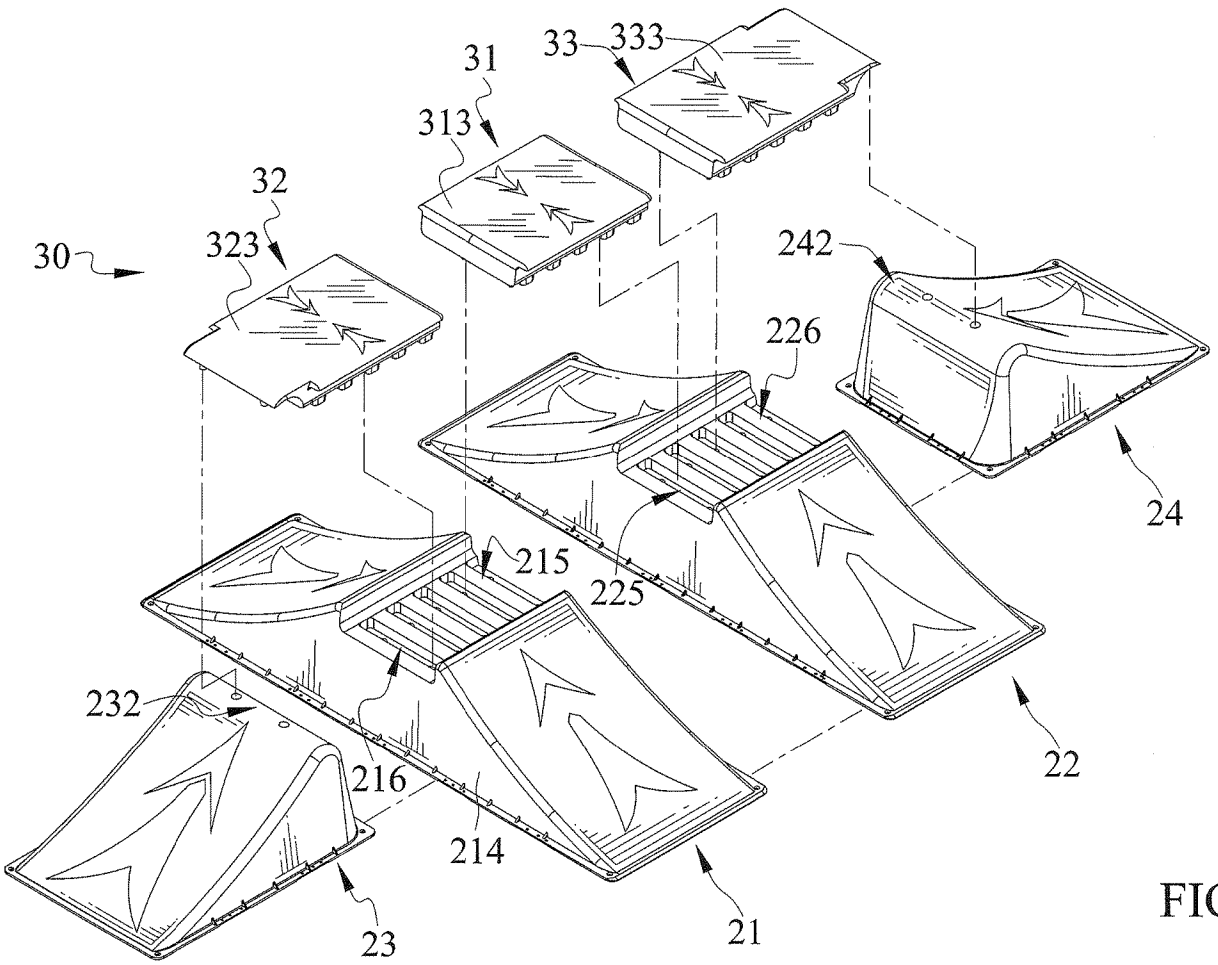
FIG. 2 is an exploded perspective view of the modular ramp shown in FIG. 1.
Figure 3:
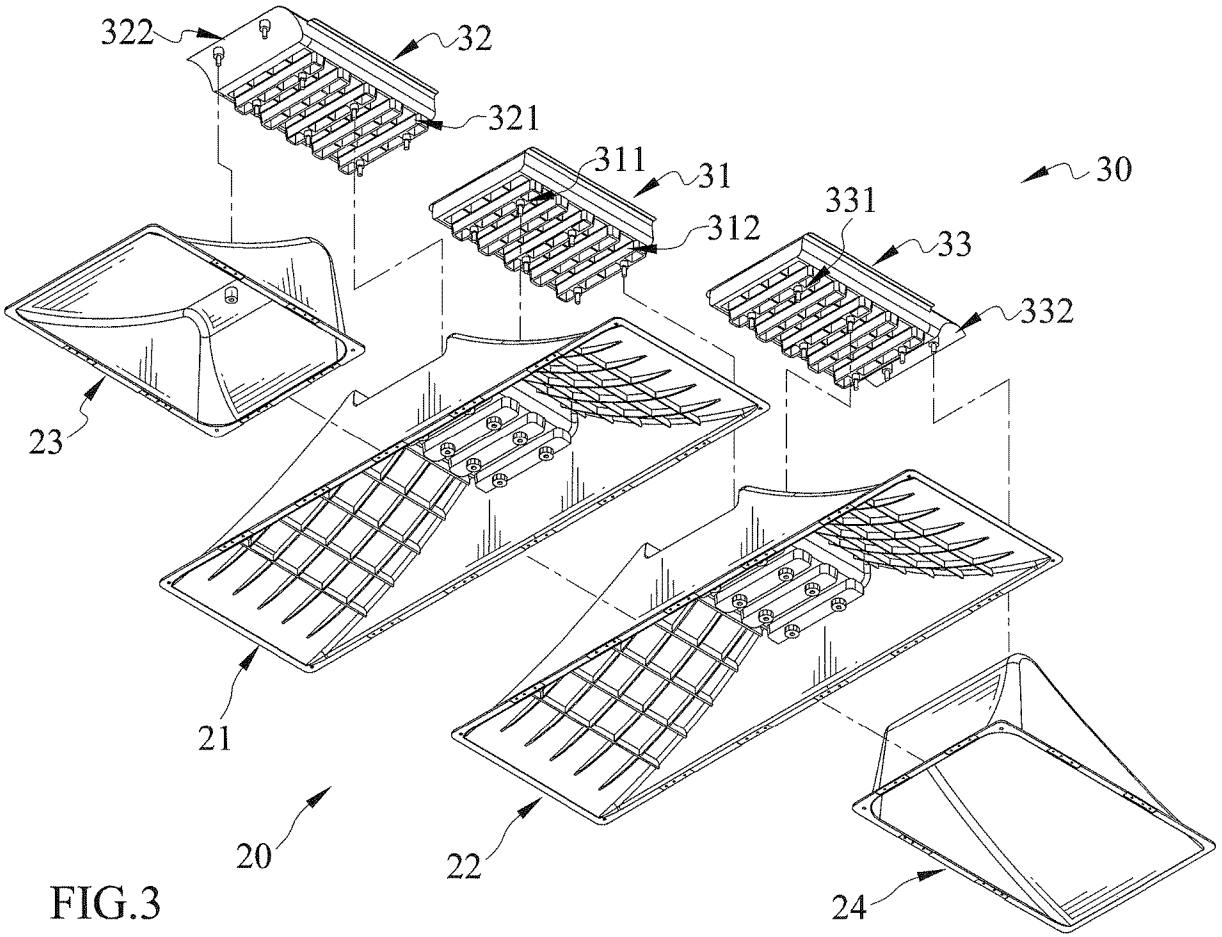
FIG. 3 is an exploded perspective seen from a different angle than that shown in FIG. 2.
Figure 4:
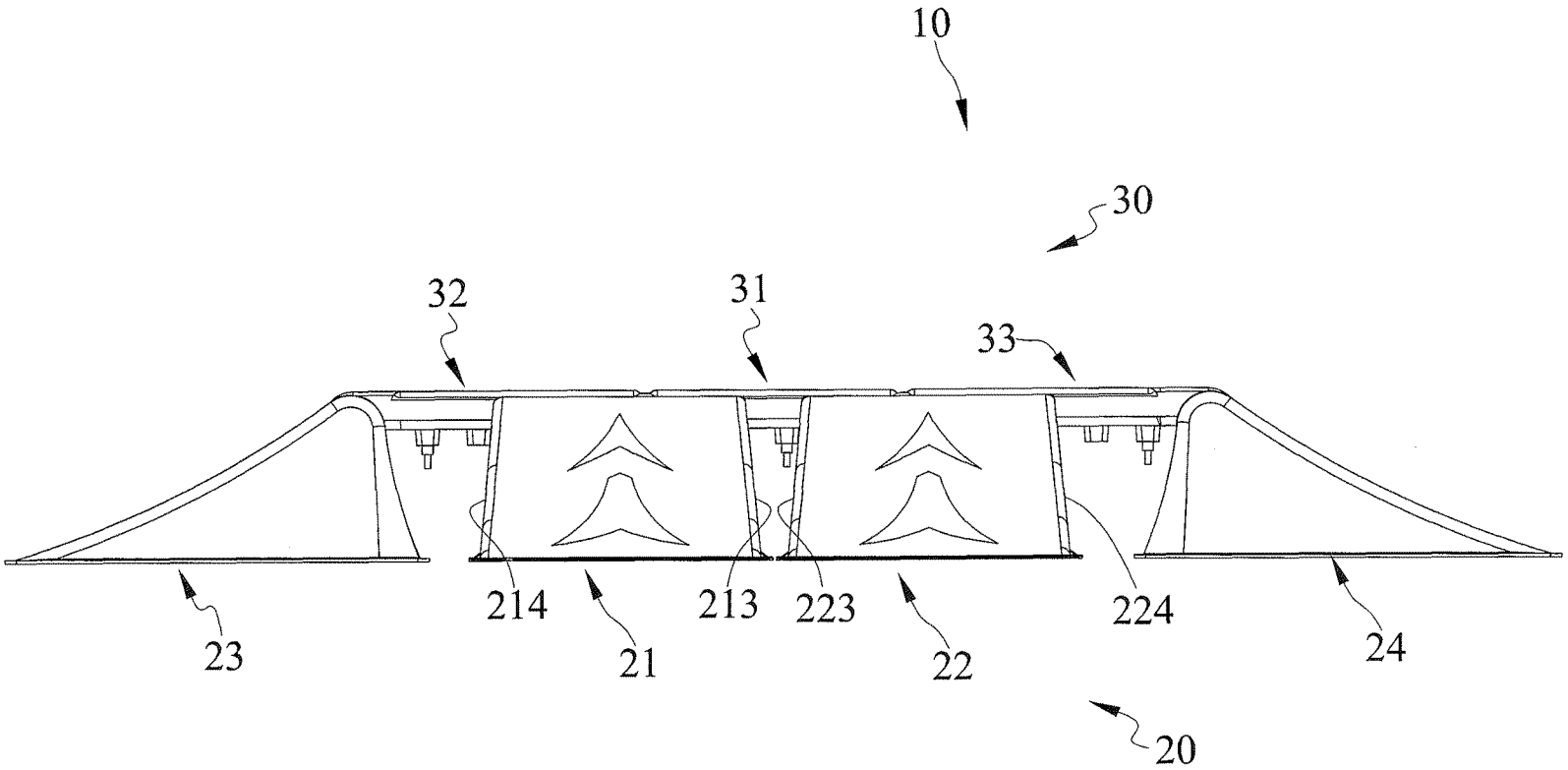
FIG. 4 is a side view of the modular ramp shown in FIG. 1.

FIGS. 1 through 4 show a modular ramp system 10 of the present invention in a first configuration. The modular ramp system 10 includes ramps 20 and connectors 30.

A first ramp component 21 is made from a single piece material and has a bottom surface for resting on the ground, a top surface above the bottom surface at a height, a first and second inclined surface 211 and 212 extending from opposite sides of the top surface to the bottom surface, and a connecting portion formed on the top surface and positioned between the first and second inclined surfaces 211 and 212. The first ramp component 21 has a first lateral side 213 and a second lateral side 214 on opposite sides, and includes the top surface and the first and second inclined surfaces 211 and 212 extending between and to the first and second lateral sides 213 and 214. The connecting portion has a first connecting section 215 located adjacent to the first lateral side 213 and a second connecting section 216 located adjacent to the second lateral side 214 respectively.

A first connector 31 is releasably joined to the connecting portion of the first ramp component 21. The first connector 31 is made from a single piece of material. The first connector 31 has a bottom side formed with a coupling portion including a first and second coupling section 311 and 312 connectible to the connecting portion. The first connector 31 is positionable in a first position in which one of the first and second coupling sections 311 and 312 is releasably joined to the connecting portion of the first ramp component 21 and the other of the first and second coupling sections 311 and 312 is adapted to releasably couple to a ramp or an external structure, and a second position in which the first and second coupling sections 311 and 312 are releasably joined to connecting portion of the first ramp component 21. The first connector 31 has a planar top 313 bridging the first and second inclined surfaces 211 and 212 of the first ramp component 21. The first inclined surface 211, the planar top 313, and the second inclined surface 212 cooperate to form a smooth surface on which a user can travel.

The connecting portion of the first ramp component 21 and the coupling portion of the first connector 31 are respectively provided with corresponding protruding portions and recessed portions. The connecting portion of the first ramp components 21 and the coupling portion of the first connector 31 are respectively provided with corresponding recessed portions and protruding portions. Each recessed portion of the connecting portion of the first ramp component 21 and each protruding portion of the coupling portion of the first connector 31 have corresponding shapes. At least one protruding portion of the coupling portion of the first connector 31 is fit into one recessed portion of the connecting portion of the first ramp component 21.

The recessed portions of the connecting portion of the first ramp component 21 extend parallel to one another for easy assembly. Likewise, the protruding portions of the coupling portion of the first connector 31 extend parallel to one another. Further, at least one aperture extends into one of the recessed portions of the connecting portion of the first ramp component 21 and at least one retaining structure protrudes out from one of the protruding portions of the coupling portion of the first connector 31. The at least one retaining structure is fit in the at least one aperture.

A second ramp component 22 is releasably coupled to the first connector 31. The second ramp component 22 is made from a single piece material and has a bottom surface for resting on the ground, a top surface above the bottom surface at a height, a first and second inclined surface 221 and 222 extending from opposite sides of the top surface to the bottom surface, and a connecting portion formed on the top surface and positioned between the first and second inclined surfaces 221 and 222. The other of the first and second coupling sections 311 and 312 of the first connector 31 is releasably joined to the connecting portion of the second ramp component 22. The planar top 313 and the first and second inclined surfaces 221 and 222 of the second ramp component 22 cooperate to form a smooth surface on which a user can travel. The second ramp component 22 has a first lateral side 223 and a second lateral side 224 on opposite sides, and includes the top surface and the first and second inclined surfaces 221 and 222 extending between and to the first and second lateral sides 223 and 224. The connecting portion has a first connecting section 225 located adjacent to the first lateral side 223 and a second connecting section 226 located adjacent to the second lateral side 224 respectively. The first lateral side 223 is adjacent the first lateral side 213. The two first lateral sides 213 and 223 face oppositely. In the embodiment, the first and the second ramp components 21 and 22 are the same shape.

The connecting portion of the second ramp component 22 and the coupling portion of the first connector 31 are respectively provided with corresponding protruding portions and recessed portions. The connecting portion of the second ramp component 22 and the coupling portion of the first connector 31 are respectively provided with corresponding recessed portions and protruding portions. Each recessed portion of the connecting portion of the second ramp component 22 and each protruding portion of the coupling portion of the second connector 32 have corresponding shapes. At least one protruding portion of the coupling portion of the first connector 31 is fit into one recessed portion of the connecting portion of the second ramp component 22.

The recessed portions of the connecting portion of the second ramp component 22 extend parallel to one another for easy assembly. Further, at least one aperture extends into one of the recessed portions of the connecting portion of the second ramp component 22 and at least one retaining structure protruding out from one of the protruding portions of the coupling portion of the second connector 32. The at least one retaining structure is fit in the at least one aperture.

A third ramp component 23 is releasably coupled to the first ramp components 21 by a second connector 32. The third ramp component 23 is made from a single piece material and has a bottom surface for resting on the ground, a top surface above the bottom surface at a height, an inclined surface 231 extending from the top surface to the bottom surface, and a connecting portion 232 formed on the top surface. The second connector 32 is made from a single piece of material. The second connector 32 has a bottom side formed with a coupling portion including a first coupling section 321 releasably joined to the connecting portion of the first ramp component 21 and a second coupling section 322 releasably joined to the connecting portion 232 of the third ramp component 23 respectively. The second connector 32 has a planar top 323 bridging the inclined surface 231 of the third ramp component 23 and the planar top 313 of the first connector 31. The inclined surface 231 of the third ramp component 23 and the planar tops 313 and 323 of the first and second connectors 31 and 32 cooperate to form a smooth surface on which a user can travel.

The connecting portion of the first ramp component 21 and the first coupling section 321 of the second connector 32 are respectively provided with corresponding protruding portions and recessed portions. The connecting portion of the first ramp component 21 and the first coupling section 321 of the second connector 32 are respectively provided with corresponding recessed portions and protruding portions. At least one protruding portion of the first coupling section 321 of the second connector 32 is fit into one recessed portion of the connecting portion of the first ramp component 21. The connecting portion 232 of the third ramp component 23 and the second coupling section 322 of the second connector 32 are respectively provided with corresponding recessed portions and protruding portions. At least one protruding portion of the second coupling section 322 of the second connector 32 is fit into one recessed portion of the connecting portion 232 of the third ramp component 23.

A fourth ramp component 24 is releasably coupled to the second ramp component 22 by a third connector 33. The fourth ramp component 24 has a bottom surface for resting on the ground, a top surface above the bottom surface at a height, an inclined surface 241 extending from the top surface to the bottom surface, and a connecting portion 242 formed on the top surface. The third connector 33 is made from a single piece of material. The third connector 33 has a bottom side formed with a coupling portion including a first coupling section 331 releasably joined to the connecting portion of the second ramp component 22 and a second coupling section 322 releasably joined to the connecting portion 242 of the fourth ramp component 24 respectively. The third connector 33 has a planar top 333 bridging the inclined surface 241 of the fourth ramp component 24 and the planar top 313 of the first connector 31. The inclined surface 241 of the fourth ramp component 24 and the planar tops 313 and 333 of the first and third connectors 31 and 33 cooperate to form a smooth surface on which a user can travel.

The connecting portion 242 of the fourth ramp component 24 and the second coupling section 332 of the third connector 33 are respectively provided with corresponding recessed portions and protruding portions. At least one protruding portion of the second coupling section 332 of the third connector 33 is fit into one recessed portion of the connecting portion 242 of the fourth ramp component 24.

Figure 5:
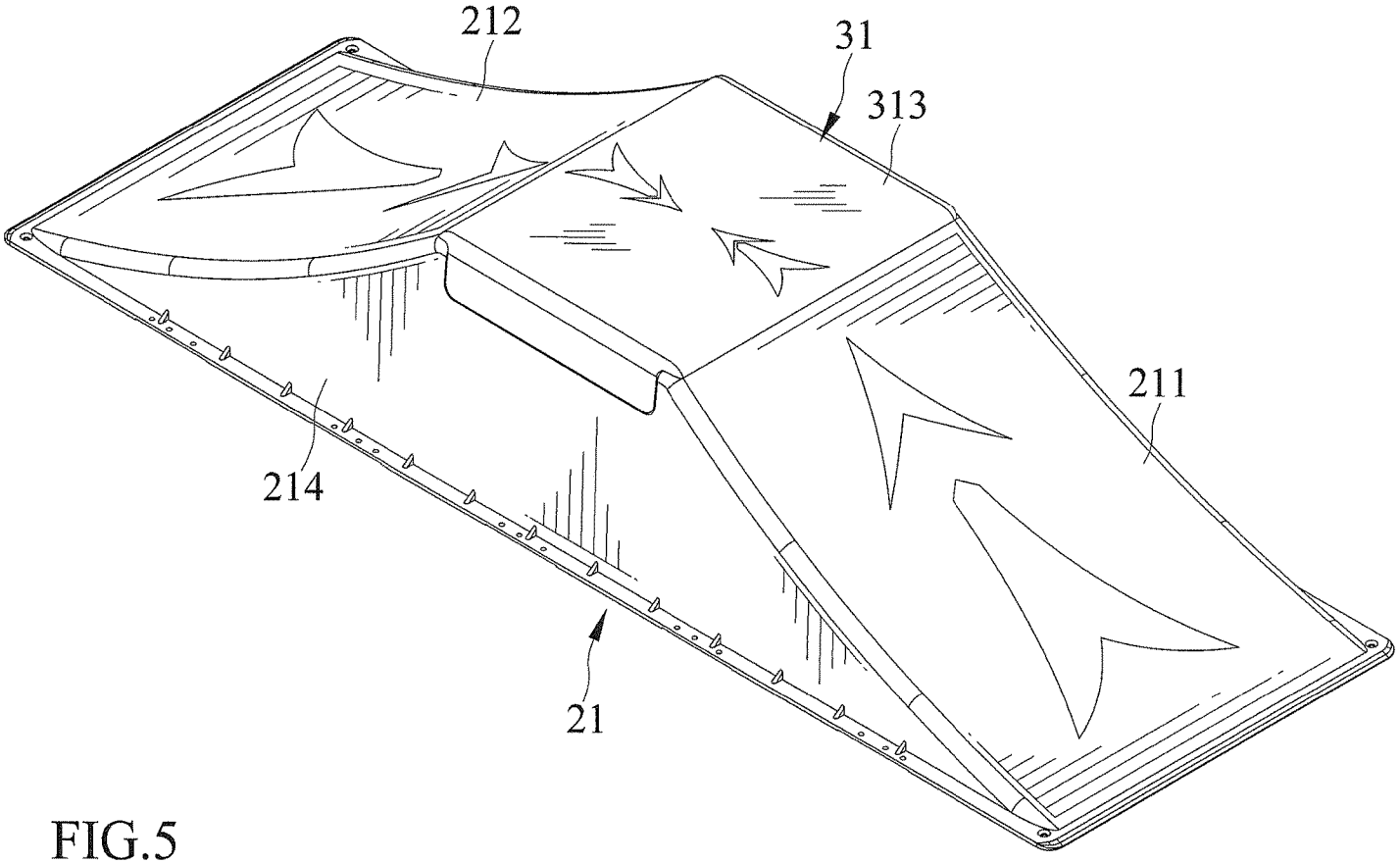
FIG. 5 is a perspective view of a modular ramp system of the present invention in a second configuration.
Figure 6:
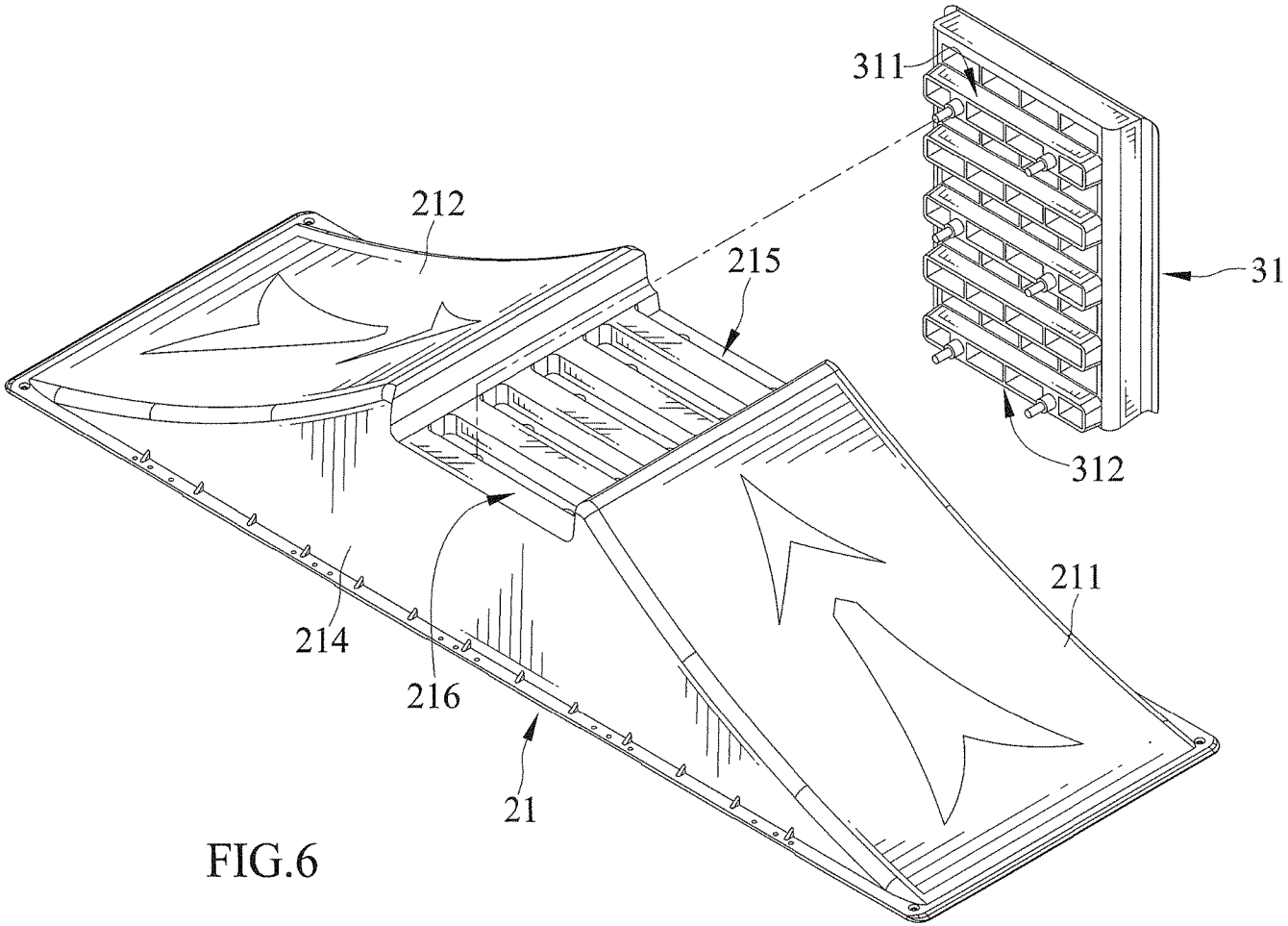
FIG. 6 is an exploded perspective view of the modular ramp shown in FIG. 5.
Figure 7:
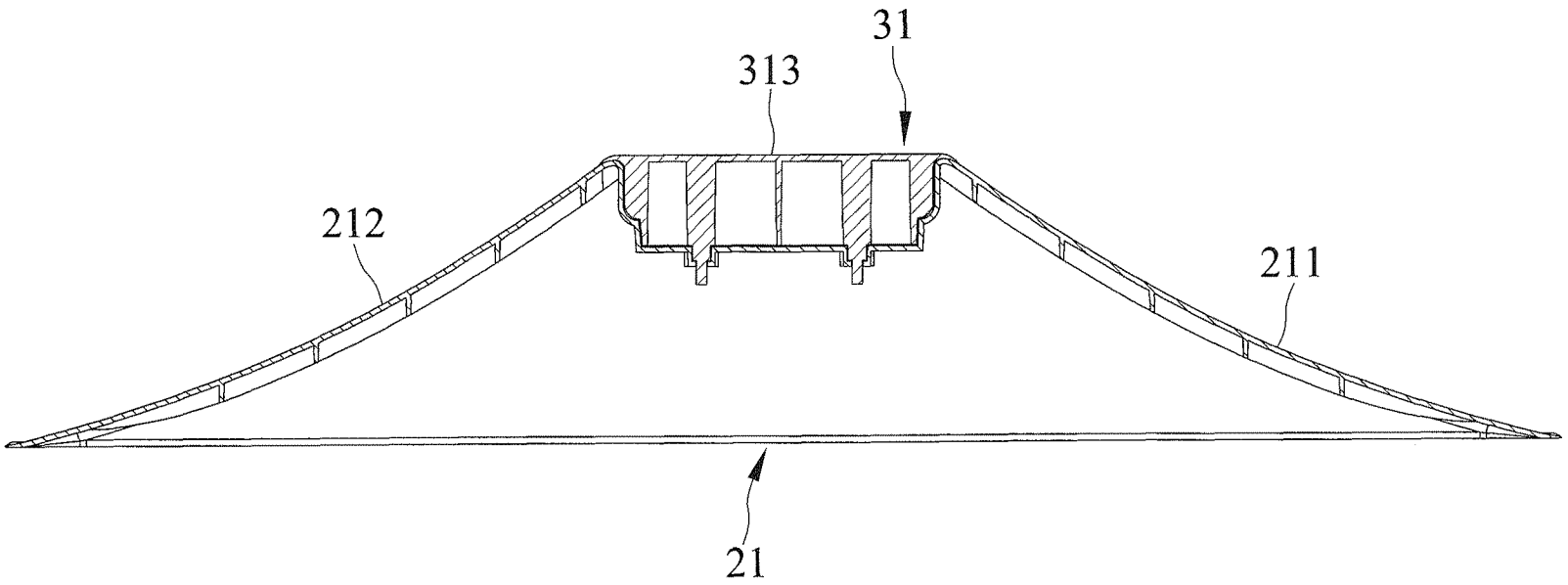
FIG. 7 is a cross-sectional view of the modular ramp shown in FIG. 5.

FIGS. 5 through 7 show the modular ramp system of the present invention in a second configuration. The ramp system includes the first connector 31 positioned in the second position in which the first and second coupling sections 311 and 312 are releasably joined to connecting portion of the first ramp component 21.

In view of the forgoing, the first, second, third, and fourth ramp components 21, 22, 23, and 24 and the connectors 31, 32, and 33 can releasably coupled together, thereby allowing the modular ramp system 10 of the present invention to have various configurations. Furthermore, the modular ramp system provides smooth surfaces for the user to travel and the components set forth can snugly fit with one another, thereby allowing the modular ramp system 10 to withstand the extreme forces.

The foregoing is merely illustrative of the principles of this invention, and various modifications can be made by those skilled in the art without departing from the scope and spirit of the invention.

What is claimed is:

1. A modular ramp system, comprising:

a first ramp component made from a single piece material and having a bottom surface, a top surface above the bottom surface at a height, a first and second inclined surface extending from opposite sides of the top surface to the bottom surface, and a connecting portion formed on the top surface and positioned between the first and second inclined surfaces; and a first connector releasably joined to the connecting portion of the first ramp component, wherein the first connector has a bottom side formed with a coupling portion including a first and second coupling section connectible to the connecting portion;

wherein the first connector is positionable in a first position in which one of the first and second coupling sections is releasably joined to the connecting portion of the first ramp component and the other of the first and second coupling sections is adapted to releasably couple to a ramp or an external structure, and a second position in which the first and second coupling sections are releasably joined to connecting portion of the first ramp component.

2. The modular ramp system as claimed in claim 1, wherein the first connector has a planar top bridging the first and second inclined surfaces of the first ramp component, and wherein the first inclined surface, the planar top, and the second inclined surface cooperate to form a smooth surface on which a user can travel.

3. The modular ramp system as claimed in claim 2, wherein the connecting portion of the first ramp component and the coupling portion of the first connector are respectively provided with corresponding protruding portions and recessed portions, wherein the connecting portion of the first ramp components and the coupling portion of the first connector are respectively provided with corresponding recessed portions and protruding portions, and wherein at least one protruding portion of the coupling portion of the first connector is fit into one recessed portion of the connecting portion of the first ramp component.

4. The modular ramp system as claimed in claim 2 further comprising a second ramp component releasably coupled to the first connector, wherein the second ramp component is made from a single piece material and has a bottom surface, a top surface above the bottom surface at a height, a first and second inclined surface extending from opposite sides of the top surface to the bottom surface, and a connecting portion formed on the top surface and positioned between the first and second inclined surfaces, wherein the other of the first and second coupling sections of the first connector is releasably joined to the connecting portion of the second ramp component, and wherein the planar top and the first and second inclined surfaces of the second ramp component cooperate to form a smooth surface on which a user can travel.

5. The modular ramp system as claimed in claim 4, wherein the connecting portion of the second ramp component and the coupling portion of the first connector are respectively provided with corresponding protruding portions and recessed portions, wherein the connecting portion of the second ramp component and the coupling portion of the first connector are respectively provided with corresponding recessed portions and protruding portions, and wherein at least one protruding portion of the coupling portion of the first connector is fit into one recessed portion of the connecting portion of the second ramp component.

6. The modular ramp system as claimed in claim 3 further comprising a third ramp component and a second connector releasably coupled to the first and third ramp components, wherein the third ramp component has a bottom surface, a top surface above the bottom surface at a height, an inclined surface extending from the top surface to the bottom surface, and a connecting portion formed on the top surface, wherein the second connector has a bottom side formed with a coupling portion including a first coupling section releasably joined to the connecting portion of the first ramp component and a second coupling section releasably joined to the connecting portion of the third ramp component respectively, wherein the second connector has a planar top bridging the inclined surface of the third ramp component and the planar top of the first connector, and wherein the inclined surface of the third ramp component and the planar tops of the first and second connectors cooperate to than a smooth surface on which a user can travel.

7. The modular ramp system as claimed in claim 6 further comprising a fourth ramp component and a third connector releasably coupled to the second and fourth ramp components, wherein the fourth ramp component has a bottom surface, a top surface above the bottom surface at a height, an inclined surface extending from the top surface to the bottom surface, and a connecting portion formed on the top surface, wherein the third connector has a bottom side formed with a coupling portion including a first coupling section releasably joined to the connecting portion of the second ramp component and a second coupling section releasably joined to the connecting portion of the fourth ramp component respectively, wherein the third connector has a planar top bridging the inclined surface of the fourth ramp component and the planar top of the first connector, and wherein the inclined surface of the fourth ramp component and the planar tops of the first and third connectors cooperate to form a smooth surface on which a user can travel.

8. The modular ramp system as claimed in claim 6, wherein the connecting portion of the first ramp component and the first coupling section of the second connector are respectively provided with corresponding protruding portions and recessed portions, wherein the connecting portion of the first ramp component and the first coupling section of the second connector are respectively provided with corresponding recessed portions and protruding portions, wherein at least one protruding portion of the first coupling section of the second connector is fit into one recessed portion of the connecting portion of the first ramp component, wherein the connecting portion of the third ramp component and the second coupling section of the second connector are respectively provided with corresponding recessed portions and protruding portions, and wherein at least one protruding portion of the second coupling section of the second connector is fit into one recessed portion of the connecting portion of the third ramp component.

9. The modular ramp system as claimed in claim 7, wherein the connecting portion of the first ramp component and the first coupling section of the second connector are respectively provided with corresponding protruding portions and recessed portions, wherein the connecting portion of the first ramp component and the first coupling section of the second connector are respectively provided with corresponding recessed portions and protruding portions, wherein at least one protruding portion of the first coupling section of the second connector is fit into one recessed portion of the connecting portion of the first ramp component, wherein the connecting portion of the third ramp component and the second coupling section of the second connector are respectively provided with corresponding recessed portions and protruding portions, and wherein at least one protruding portion of the second coupling section of the second connector is fit into one recessed portion of the connecting portion of the third ramp component.

10. The modular ramp system as claimed in claim 9, wherein the connecting portion of the second ramp component and the first coupling section of the third connector are respectively provided with corresponding protruding portions and recessed portions, wherein the connecting portion of the second ramp component and the first coupling section of the third connector are respectively provided with corresponding recessed portions and protruding portions, wherein at least one protruding portion of the first coupling section of the third connector is fit into one recessed portion of the connecting portion of the second ramp component, wherein the connecting portion of the fourth ramp component and the second coupling section of the third connector are respectively provided with corresponding recessed portions and protruding portions, and wherein at least one protruding portion of the second coupling section of the third connector is fit into one recessed portion of the connecting portion of the fourth ramp component.

11. The modular ramp system as claimed in claim 3, wherein the recessed portions of the connecting portion of the first ramp component extend parallel to one another.

12. The modular ramp system as claimed in claim 11 further comprising at least one aperture extending into one of the recessed portions of the connecting portion of the first ramp component and at least one retaining structure protruding out from one of the protruding portions of the coupling portion of the first connector, and wherein the at least one retaining structure is fit in the at least one aperture.

13. The modular ramp system as claimed in claim 12, wherein each recessed portion of the connecting portion of the first ramp component and each protruding portion of the coupling portion of the first connector have corresponding shapes.

14. The modular ramp system as claimed in claim 4, wherein the recessed portions of the connecting portion of the first ramp component extend parallel to one another.

15. The modular ramp system as claimed in claim 14 further comprising at least one aperture extending into one of the recessed portions of the connecting portion of each of the first and second ramp components and at least one retaining structure protruding out from one of the protruding portions of the coupling portion of the first connector, and wherein the at least one retaining structure is fit in the at least one aperture.

16. The modular ramp system as claimed in claim 15, wherein each recessed portion of the connecting portions of the first and second ramp components and each protruding portion of the coupling portion of the first and second connectors have corresponding shapes.

* * * * *